US008347553B2

(12) United States Patent
Hecht et al.

(10) Patent No.: US 8,347,553 B2
(45) Date of Patent: Jan. 8, 2013

(54) DRIVE DEVICE FOR REFRIGERATOR DOORS

(75) Inventors: Josef Hecht, Erlenmoos (DE); Dietmar Blersch, Ertingen (DE); Armin Pfister, Nürnberg (DE); Florian Stephan, Herzogenaurach (DE); Jens Scharg, Fürth (DE); Markus Kegel, Altdorf (DE); Herbert Müller, Nürnberg (DE)

(73) Assignees: SUSPA GmbH, Altdorf B. Nuernberg (DE); Liebherr-Hausgeraete Ochsenhausen GmbH, Ochsenhausen (DE)

( * ) Notice: Subject to any disclaimer, the term of this patent is extended or adjusted under 35 U.S.C. 154(b) by 546 days.

(21) Appl. No.: 12/508,970

(22) Filed: Jul. 24, 2009

(65) Prior Publication Data

US 2010/0018122 A1 Jan. 28, 2010

(30) Foreign Application Priority Data

Jul. 24, 2008 (DE) ..... 10 2008 034 809

(51) Int. Cl.
*A47B 96/04* (2006.01)

(52) U.S. Cl. ..... 49/358; 49/324; 312/319.5; 312/405

(58) Field of Classification Search ..... 49/358, 49/359, 324, 339, 340, 345; 312/405, 319.5, 312/326, 327
See application file for complete search history.

(56) References Cited

U.S. PATENT DOCUMENTS 3,864,875 A * 2/1975 Hewitt ..... 49/115
4,225,204 A * 9/1980 Bellavoine ..... 312/236
4,727,679 A * 3/1988 Kornbrekke et al. ..... 49/138
4,731,950 A * 3/1988 Ullner ..... 49/221
5,040,857 A * 8/1991 Mandel et al. ..... 312/405
6,108,975 A * 8/2000 Bailey ..... 49/334
6,230,137 B1 * 5/2001 Has et al. ..... 704/275
6,338,536 B1 * 1/2002 Ueno et al. ..... 312/405
6,460,294 B1 * 10/2002 Harkins ..... 49/345
6,525,659 B2 * 2/2003 Jaffe et al. ..... 340/545.6
6,811,236 B1 * 11/2004 Spong et al. ..... 312/405
6,845,545 B2 * 1/2005 Han et al. ..... 16/277
7,192,105 B2 * 3/2007 Jung ..... 312/405
7,213,369 B2 * 5/2007 Freeman ..... 49/358
7,517,031 B2 * 4/2009 Laible ..... 312/406.2

(Continued)

FOREIGN PATENT DOCUMENTS

CN 2 367 895 Y 3/2000

(Continued)

OTHER PUBLICATIONS

English Translation of Chinese Patent Application Office Action of Chinese patent application CN 2009/10164778.5 issued Sep. 13, 2012.

*Primary Examiner* — Katherine W Mitchell
*Assistant Examiner* — Justin Rephann
(74) *Attorney, Agent, or Firm* — Browdy and Neimark, P.L.L.C.

(57) ABSTRACT

An arrangement comprises a housing, in particular of a cooling and/or freezing device, a door which is articulated to the housing so as to be pivotable about a pivot axis of a hinge, and at least one drive device for pivoting the door relative to the housing, with the drive device comprising a drive unit by means of which a moment is exertable on the door relative to the hinge axis via at least one force transmission means.

23 Claims, 11 Drawing Sheets

U.S. PATENT DOCUMENTS

| | | | | |
|---|---|---|---|---|
| 2004/0040118 | A1* | 3/2004 | Han et al. | 16/277 |
| 2004/0108798 | A1* | 6/2004 | Laible | 312/405 |
| 2005/0218766 | A1* | 10/2005 | Hwang | 312/405 |
| 2005/0258724 | A1* | 11/2005 | Hwa Kim | 312/405 |
| 2005/0262868 | A1* | 12/2005 | Jeong et al. | 62/408 |
| 2006/0232176 | A1* | 10/2006 | Kim et al. | 312/405 |
| 2006/0238091 | A1* | 10/2006 | Linke et al. | 312/405 |
| 2007/0186480 | A1* | 8/2007 | Freeman | 49/358 |
| 2008/0172838 | A1* | 7/2008 | Choi | 16/366 |
| 2008/0189906 | A1* | 8/2008 | Resnik et al. | 16/54 |
| 2008/0284301 | A1* | 11/2008 | Kim | 312/405 |
| 2009/0033189 | A1* | 2/2009 | Glanz et al. | 312/405 |
| 2009/0139146 | A1* | 6/2009 | Houser et al. | 49/340 |
| 2009/0160297 | A1* | 6/2009 | Anikhindi et al. | 312/319.7 |
| 2009/0322470 | A1* | 12/2009 | Yoo et al. | 340/3.1 |

FOREIGN PATENT DOCUMENTS

| | | | |
|---|---|---|---|
| DE | 9206086 | U1 | 5/1993 |
| DE | 202005011427 | U1 | 11/2006 |
| DE | 102006019332 | A1 | 12/2006 |
| WO | 2007009783 | A1 | 1/2007 |

* cited by examiner

DRIVE DEVICE FOR REFRIGERATOR DOORS

BACKGROUND OF THE INVENTION

1. Field of the Invention

The invention relates to an arrangement comprising a housing, a door articulated thereto and a drive device for pivoting the door relative to the housing.

2. Background Art

Automatic drives may facilitate the opening of a door. When opening a refrigerator door, however, there is the problem of a particularly high initial force that needs to be overcome in order to overcome a vacuum which develops inside the refrigerator when the door is closed. Moreover, it is usually expected that the door can be opened manually as well without causing damage to the drive device. This generally requires a complicated mechanism.

SUMMARY OF THE INVENTION

It is therefore the object of the invention to improve a drive device for refrigerator doors.

This object is achieved by an arrangement comprising a housing, in particular of a cooling and/or freezing device, a door which is articulated to the housing so as to be pivotable about a pivot axis of a hinge, and at least one drive device for pivoting the door relative to the housing, with the drive device comprising a drive unit by means of which a moment is exertable on the door relative to the hinge axis via at least one force transmission means.

The gist of the invention is to couple the drive unit to a hinge of the refrigerator door by means of force transmission elements.

Features and details of the invention will become apparent from the description of several embodiments by means of the drawing.

DESCRIPTION OF THE PREFERRED EMBODIMENT

Figure 1:
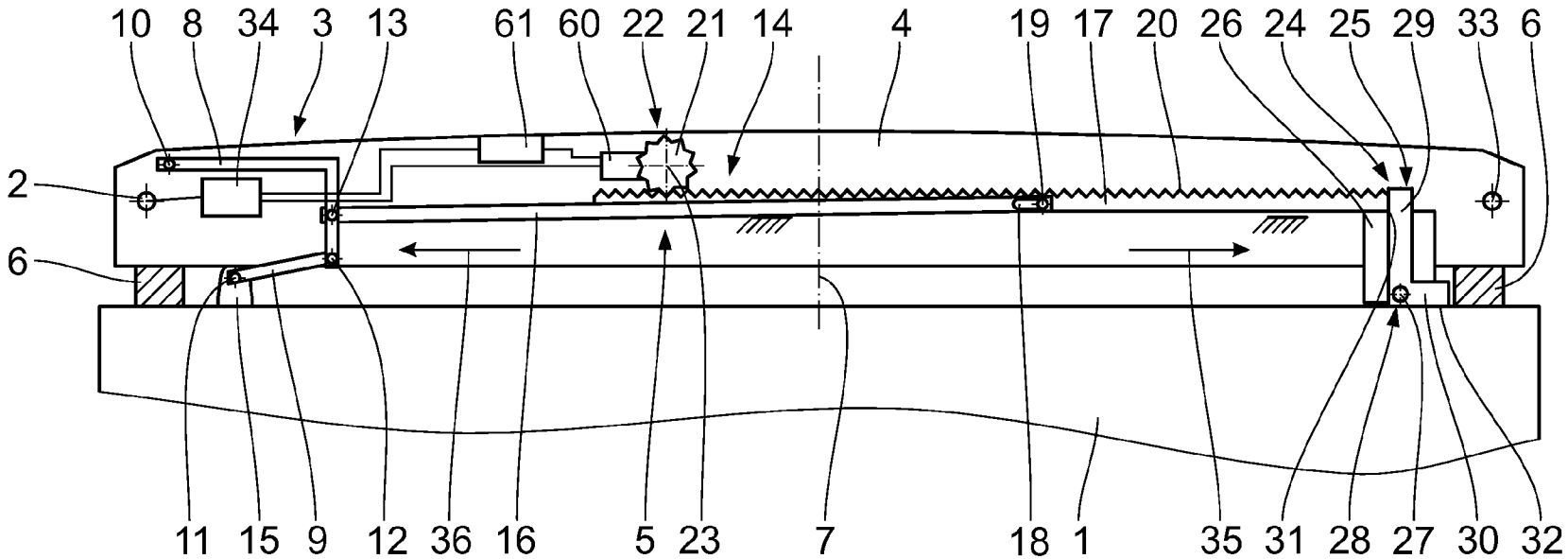
FIG. 1 is a diagrammatic view of an arrangement according to a first embodiment with the door in the closed position.
Figure 2:
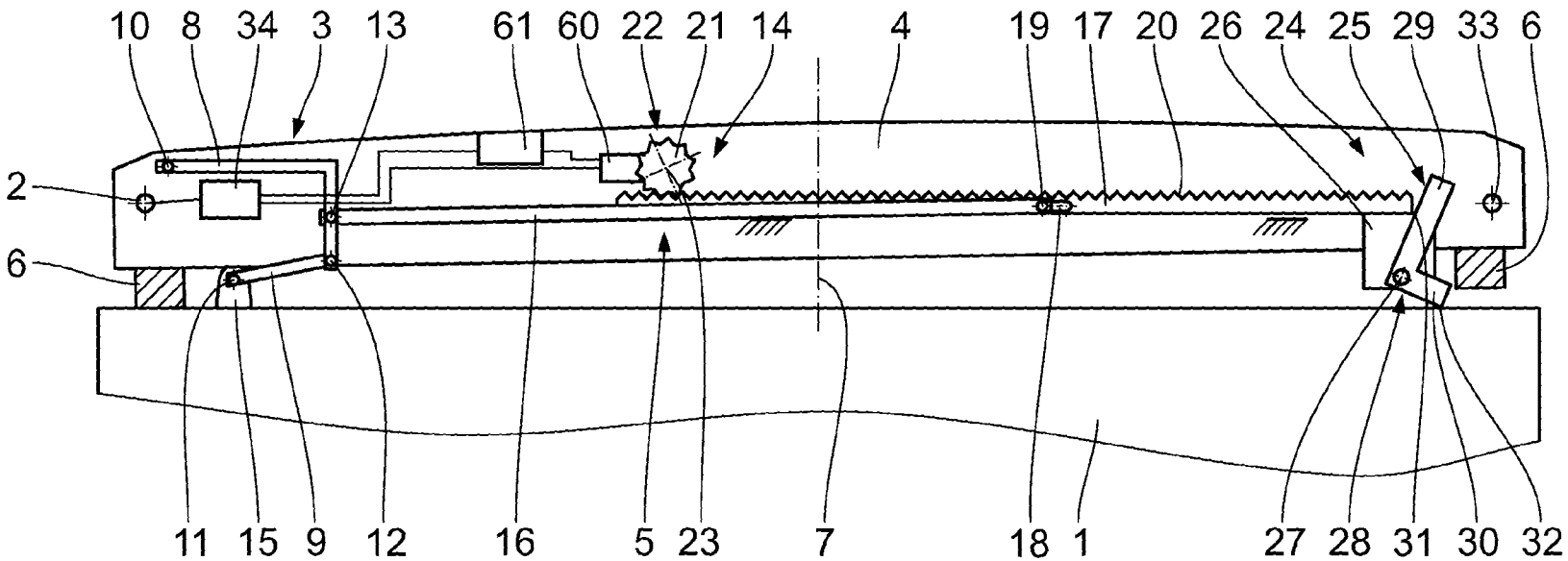
FIG. 2 is a view according to FIG. 1 with the door in the open position.
Figure 3:
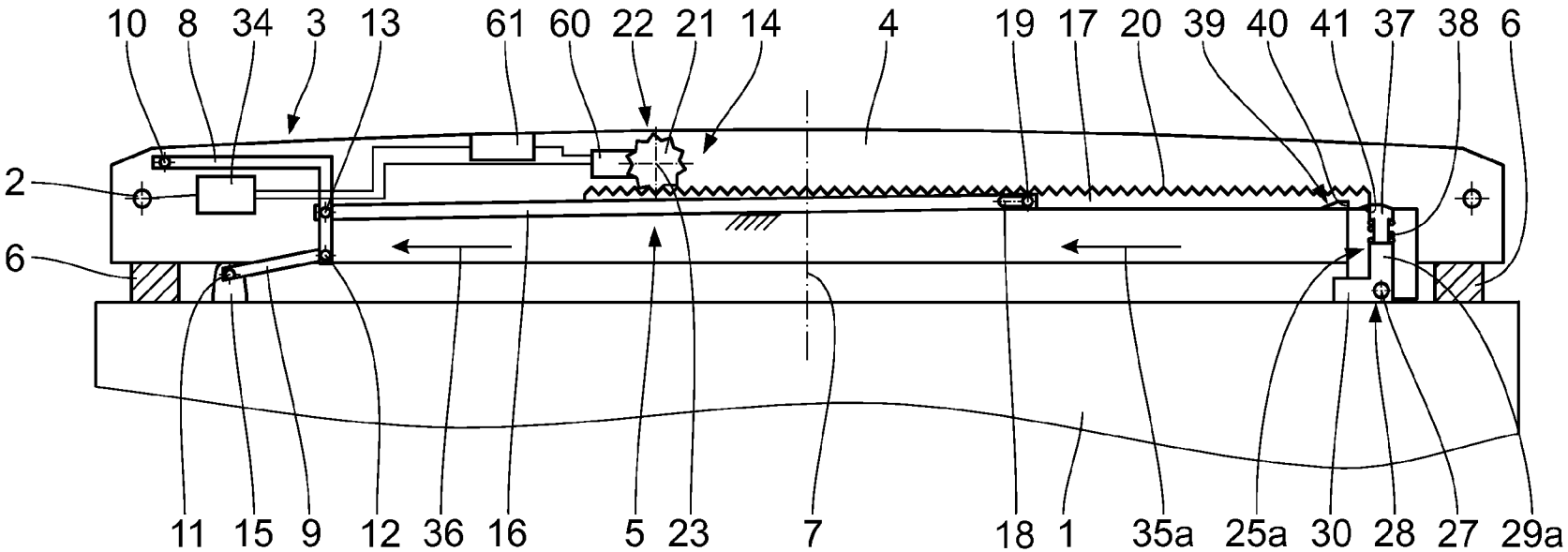
FIG. 3 is a view of an arrangement according to a second embodiment with the door in a first closed position.
Figure 4:
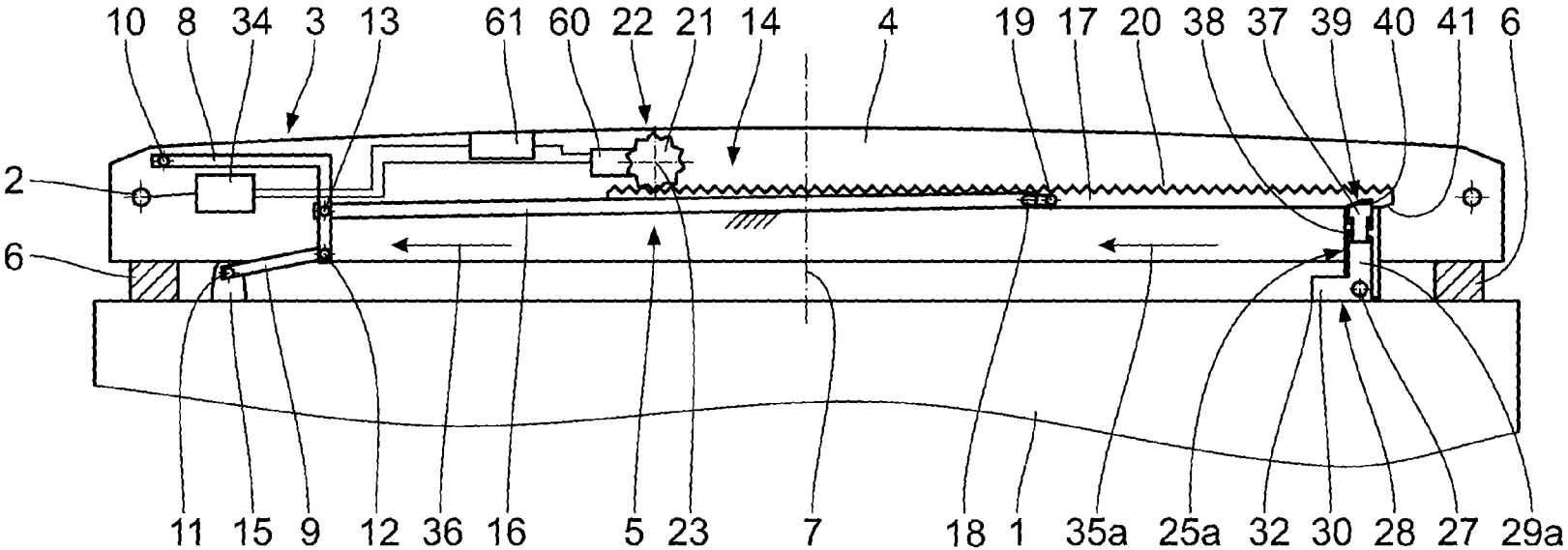
FIG. 4 is a view of the arrangement according to FIG. 3 with the door in a second closed position.
Figure 5:
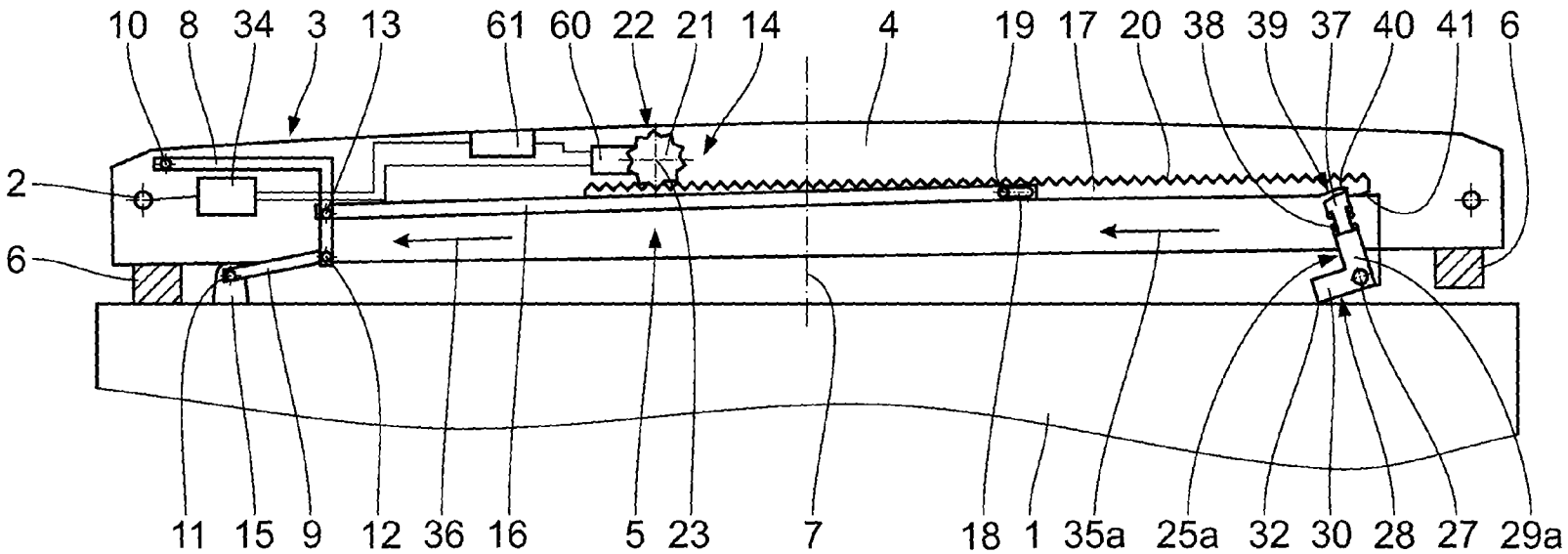
FIG. 5 is a view of the arrangement according to FIG. 4 when the door is being opened.
Figure 6:
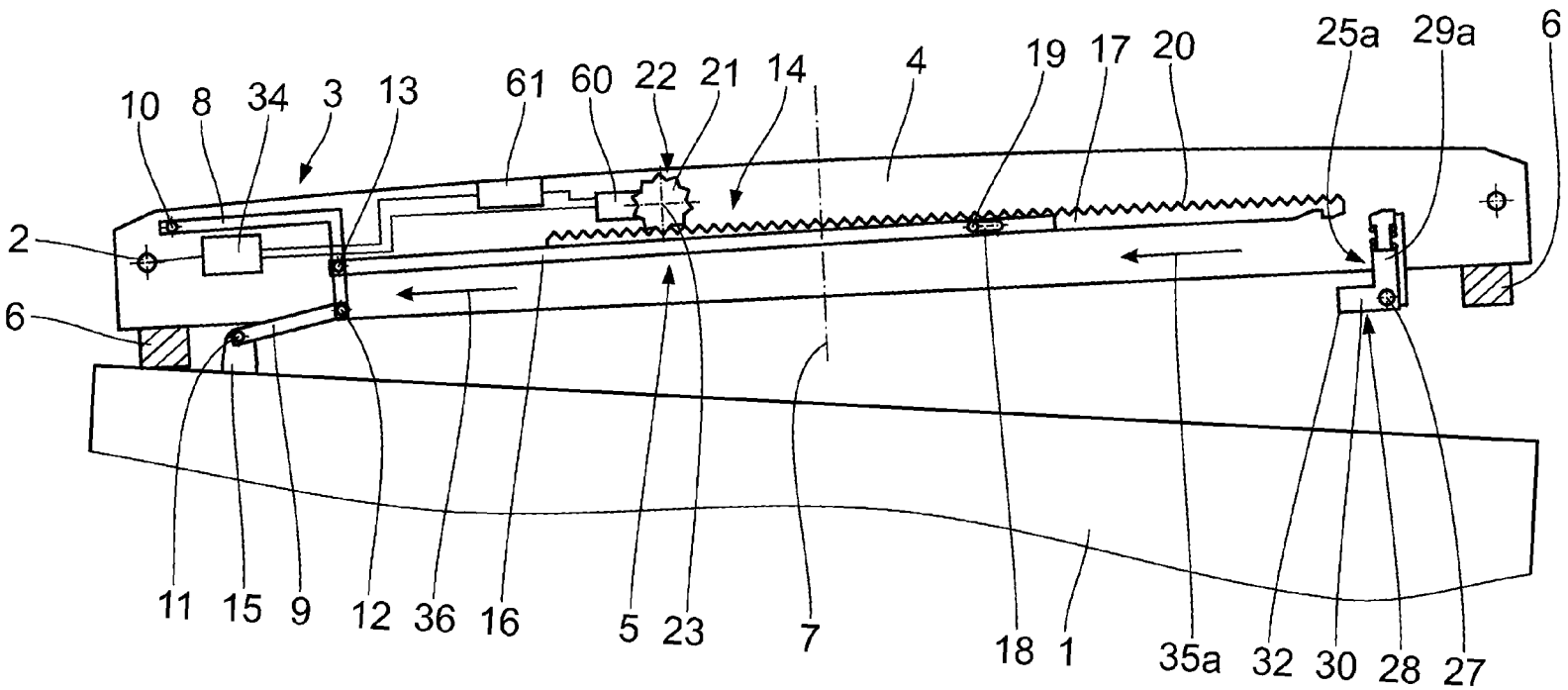
FIG. 6 is a view of the arrangement according to FIG. 5 with the door in the open state.

The following is a description of a first embodiment of the invention with reference to FIGS. 1 and 2. The arrangement according to the invention comprises a housing 1, in particular of a refrigerator and/or a freezer, which is only shown diagrammatically in the Figures, a door 4 which is articulated to the housing 1 by means of a hinge 3 so as to be pivotable about a pivot axis 2, and a drive device 5 for pivoting the door 4 relative to the housing 1. Furthermore, a sealing element 6 is provided which is disposed between the door 4 and the housing 1 in a sealing manner when the door 4 is closed, allowing the housing 1 to be hermetically sealed towards the outside by means of the door 4.

The door 4 is mirror-symmetric to a central plane 7 which is parallel to the pivot axis 2. The hinge 3 is therefore optionally mountable on the one or on the other side of the central plane 7. The opening direction of the door 4 is thus freely selectable.

The hinge 3 comprises a first leg 8 which is articulated to the door 4 by means of a first joint 10, and a second leg 9 which is articulated to the housing 1 by means of a second joint 11. The second joint 11 is secured to the housing 1 by means of a retaining plate 15. The two legs 8, 9 are in turn pivotally interconnected by means of a third joint 12. Finally, a gear rack 14 is articulated to the first leg 8 by means of a fourth joint 13. Each of the joints 10, 11, 12, 13 permits a pivoting movement about an axis parallel to the pivot axis 2.

The first joint 10 is arranged at a distance from the pivot axis 2. The first leg 8 is in the shape of an L. This ensures a particularly space-saving, compact design of the hinge 3. In a particularly advantageous embodiment, it is intended to provide several alternative positions for the arrangement of the fourth joint 13 in order to articulate the gear rack 14 to the first leg 8. This allows the lever ratio of the hinge 3, in particular the interaction of the gear rack 14 of the drive device 5 with the hinge 3, to be adapted to the particular requirements.

It is also conceivable for several hinges 3 to be arranged one above the other, for instance on the upper and lower edge of the door 4. In this case, both the hinges 3 and the drive device 5 are advantageously integrated into the door 4. The door 4 is provided with recesses for integrating the drive device 5, with the recesses being arranged outside a sealing area of the housing 1 so as to be thermally insulated from an inner region of the housing 1.

The hinge 3 is comprised of several components, in particular several axes. It is comprised of in particular at least two, advantageously at least three, in particular at least 4 pivot axes. A particularly advantageous embodiment of the hinge 3 is described in DE 10 2006 019 332 A1.

The gear rack 14 is comprised of two components. It is comprised of a first component 16 which is connected to the first leg 8 of the hinge 3 via the fourth joint 13, and a second component 17 which is connected to the first component 16. The two components 16, 17 are linearly displaceable relative to each other along a predetermined path. To this end, the second component 17 is provided with an oblong cutout 18 which is engaged by a pin 19 arranged on the first component 16. The displaceability of the two components 16, 17 relative to each other is thus limited by the displaceability of the pin 19 in the cutout 18. The second component 17 is comprised of a plurality of teeth 20 which are in engagement with a gearwheel 21 of a gear 22. The gearwheel 21 of the gear 22 is drivable for rotation about a drive axis 23 by means of a drive unit 60, in particular an electric motor, which is only shown diagrammatically in the Figures. In the gear 22 is provided a coupling. The coupling serves as an overload protection for the drive device 5 for instance when the door 4 is opened manually or if the door 4 becomes jammed in an unforeseen manner. The coupling is an electromagnetic or a mechanical coupling. An electromagnetic coupling allows the drive device 5 to be switched on or off in a particularly easy manner. This allows one to switch between manual and automatic operation.

By means of the gear rack 14, forces for moving the door 4 are transmittable from the electric motor to the hinge 3 which forms a kinematic system. The gear rack 14 is linearly displaceable; the drive device 5 is therefore referred to as linear drive. By means of the electric motor, a moment is exertable on the door 4 relative to the pivot axis 2. Depending on the direction of rotation of the gearwheel 21 about the drive axis 23, the door 4 is thus openable or closable by means of the electric motor.

An opener 24 is provided on the side of the door 4 which is opposite to the pivot axis 2 relative to the central plane 7. The opener 24 comprises an L-shaped handle 25 which is pivotable about a handle pivot axis 27. The handle pivot axis 27 is part of a handle joint 28 which is fastened to the door 4 by means of a second retaining plate 26. The handle joint 28 comprises a return element, which is in particular designed as a spring, for automatically returning the handle joint 28 to the initial position shown in FIG. 1.

The handle 25 of the opener 24 is manually operable, in other words pivotable about the handle pivot axis 27. The handle 25 of the opener 24 is furthermore actuable via the second component 17 of the gear rack 14 by means of the electric motor.

The handle 25 is in the shape of an L and comprises a first handle leg 29 and a second handle leg 30. The handle legs 29, 30 are perpendicular to each other. In an advantageous embodiment, the second handle leg 30 can advantageously be designed in such a way as to roll off along the corpus 2 when opening the door 4. The first handle leg 29 is engageable with the second component 17 of the gear rack 14. Correspondingly, the second handle leg 30 is engageable with the housing 1. The first handle leg 29 forms a first lever arm for a pivoting movement of the handle 25 about the handle pivot axis 27. The length of the lever arm formed by the first handle leg 29 is obtained from the distance of a first contact point 31 between the gear rack 14 on the one hand and the handle pivot axis 27 on the other. Correspondingly, the second handle leg 30 forms a second lever arm whose length is determined by the distance of a second contact point 32 between the handle 25 and the housing 1. The first lever arm is longer than the second lever arm. It is in particular at least 1.5 times, advantageously at least 2 times as long as the second lever arm. The force, which is transmittable by means of the gear rack 14 in order to overcome an initial resistance when opening the door 4, is easily adjustable by selecting suitable dimensions for the handle legs 29, 30 and/or by a defined arrangement of the handle pivot axis 27 relative to the two contact points 31, 32.

In the door 4 is provided a pivot axis preparation 33 which is mirror-symmetric to the pivot axis 2 relative to the central plane 7.

Advantageously, a sensor 34 is provided in the drive device 5 for monitoring the position of the gear rack 14 and therefore the open position of the door 4 relative to the housing 1. In order to actuate the electric motor of the drive device 5, the sensor 34 is connected for data transmission to a control unit 61 which is only shown diagrammatically. Data transmission can be analog or digital. The sensor 34 is furthermore connected to the drive unit 60 in a corresponding manner. The sensor 34 is in particular an angle sensor which is able to detect the pivoted position of the door 4 relative to pivot axis 2. The control unit 61 is also connected to the drive unit 60 for data transmission. It is integrated in the door 4. It may however be arranged in the door 4 in such a way as to be accessible by a user. The control unit 61 allows the user to define preferably various opening parameters of the door 4. In particular the speed profile of the opening and/or closing movement of the door 4 is adjustable by means of the control unit 61. Moreover, the user is able to adjust the maximum opening angle of the door 4 by means of the control unit 61. Finally, a maximum door ajar time of the door 4 is adjustable by means of the control unit 61; as soon as this time has expired, the drive device 5 closes the door 4 automatically. The opening angle that is adjustable by the user, in other words the maximum angle through which the door 4 is pivotable from the closed position shown in FIG. 1 about the pivot axis 2, is in the range of 20° to 180°, in particular in the range of 70° to 130°.

The drive device 5 has a modular design and is therefore easily retrofittable.

The following is a description of the function of the arrangement. In order to open the door 4 from the closed position shown in FIG. 1, an initial resistance needs to be overcome which is caused by the magnetic force of the seal and/or by a relative vacuum inside the housing 1. To this end, the handle 25 of the opener 24 is pivoted about the handle pivot axis 27. This may either be performed by actuating the handle 25 manually or by means of the electric motor of the drive device 5. When the handle 25 is pivoted by means of the drive device 5, the gearwheel 21 is rotated about the drive axis 23 in such a way that the second component 17 of the gear rack 14 is displaced in an actuation direction 35 so as to engage with the first handle leg 29 of the handle 25 for pivoting said handle 25 about the handle pivot axis 27. This causes the second contact point 32 of the second handle leg 30 to be pressed against the housing 1 so that the door 4 is opened. Due to the lever arm ratio of the first handle lever 29 to the second handle lever 30, the drive device 5 requires only a minute amount of power in order to overcome even considerable initial resistances. The dimensions of the handle 25, in particular the lever arm ratio of the first handle leg 29 to the second handle leg 30, is in particular adapted to the volume and/or the cooling efficiency of the cooling device.

After actuation of the opener 24, in particular the handle 25, the direction of rotation of the electric motor is reversed by means of the control unit 61. Reversion takes place after a defined, predetermined time. It is however conceivable as well to control said reversion process by means of the control unit 61 in such a way that it is initiated as soon as the end position of the second component 17 of the gear rack 14 is reached, for instance when the pin 19 makes contact with the cutout 18.

In order to open the door 4 further, the first component 16 of the gear rack 14 is displaced, via the gearwheel 21, in an opening direction 36 by means of the drive device 5. The opening direction 36 is opposite to the actuation direction 35. This causes a moment to be exerted on the door 4 relative to the pivot axis 2 via the hinge 3. In a particularly advantageous embodiment, various opening parameters of the door 4 are adjustable by means of the control device 61. It may for instance be intended to define the opening speed, the end position of the door 4 and a maximum door ajar time after which the door 4 is automatically closed by means of the drive device 5. Opening of the door 4 is monitored by means of the sensor 34. This ensures that the opening and closing speed of the door 4 is independent of its load, thus allowing the user to define an individual door speed via the control device 61. When opening and/or closing the door 4, obstacles are detectable quickly and easily by means of the power consumption of the drive unit 60 and/or by means of a deviation of the angular speed of the door 4 relative to the pivot axis 2 from a speed pattern defined by the control unit 61. In such a case, the opening and/or closing process can be interrupted and/or reversed by means of the control unit 61. This allows one to interrupt an automatic opening or closing of the door 4 easily by hand.

In order to close the door 4, the first component 16 of the gear rack 14 is displaced opposite to the opening direction 36.

The following is a description of a second embodiment of the invention with reference to FIGS. 3 to 6. Identical parts are denoted by the same reference numerals as in the first embodiment to the description thereof reference is made. Differently constructed but functionally identical parts are denoted by the same reference numerals with a subsequent a. The second embodiment mainly differs from the first embodiment in the design of the handle 25*a* and the interaction thereof with the gear rack 14.

According to the second embodiment, the handle 25*a* is arranged relative to the handle pivot axis 27 in such a way that in order to overcome the initial resistance when opening the door 4, it is pivoted about the handle pivot axis 27 in the same direction as the door 4 relative to the pivot axis 2 when the door 4 is opened further. In other words, the actuation direction 35*a* coincides with the opening direction 36 in this embodiment.

The first handle leg 29*a* is telescopic. It comprises a latching element 37 which is displaceable in the leg direction. The latching element 37 is resiliently mounted in the handle 25*a* by means of a latching spring 38. The latching element 37 comprises an outer contour which corresponds to an inner contour of a latching recess 39 in the second component 17 of the gear rack 14. On its side facing away from the pivot axis 2, the latching recess 39 comprises an engagement flank 40 which is perpendicular to the actuation direction 35*a*. On its axis facing the pivot axis 2, the latching recess 39 is chamfered. Furthermore, the second component 17 of the gear rack 14 comprises a chamfer 41 on its end facing away from the pivot axis 2.

When the door 4 is being closed, the gear rack 14 is at first not in engagement with the handle 25*a*. When the second component 17 of the gear rack 14 is displaced opposite to the opening and actuation direction 36, 35*a*, said second component 17 is pushed over the latching element 37 of the handle 25*a*. When this happens, the chamfer 41 slides along the contour of the latching element 37 and presses said latching element 37 slightly inwards opposite to the force of the latching spring 38. The second component 17 of the gear rack 14 is displaced opposite to the actuation direction 35*a* until the latching recess 39 engages with the latching element 37. In this position, the engagement flank 40 abuts the side of the latching element 37 facing away from the pivot axis 2. When the second component 17 of the gear rack 14 is displaced away from this position in the actuation direction 35*a*, the handle 25*a* is pivoted about the handle pivot axis 27, thus causing the second handle leg 30 to be pressed against the housing 1 at the second contact point 32 so that the door 4 is opened against the initial resistance. When the handle 25*a* has been pivoted about the handle pivot axis 27 through a particular angle, the gear rack 14 disengages from the handle 25*a*. When the gear rack 14 is displaced further in the opening and actuation direction 36, 35*a*, the gear rack 14 no longer interacts with the handle 25*a*. The handle 25*a* is then automatically pivoted back into its initial position by virtue of the return element in the handle joint 28. In order to open the door 4 further, the gear rack 14—in particular also the first component 16 thereof—is displaced in the opening direction 36.

Figure 7:
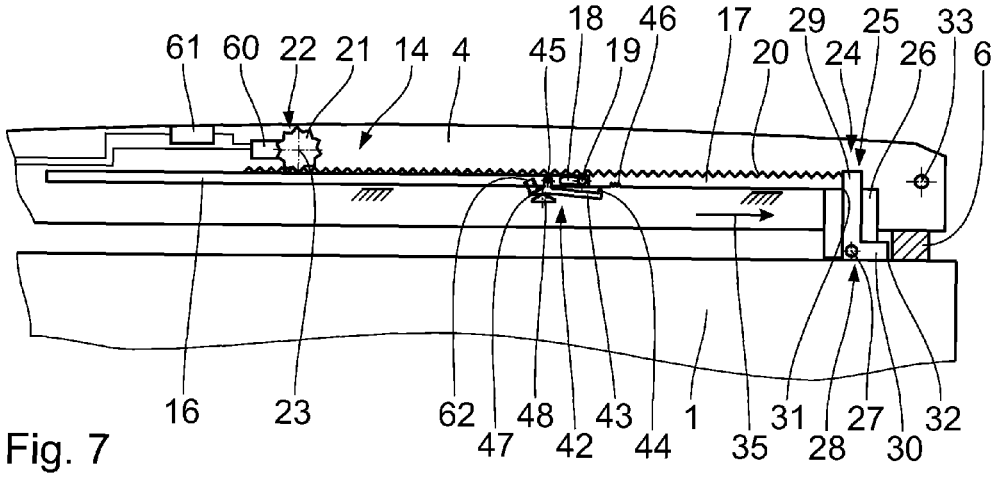
FIGS. 7, 8 and 9 are views of an arrangement according to a third embodiment.
Figure 8:
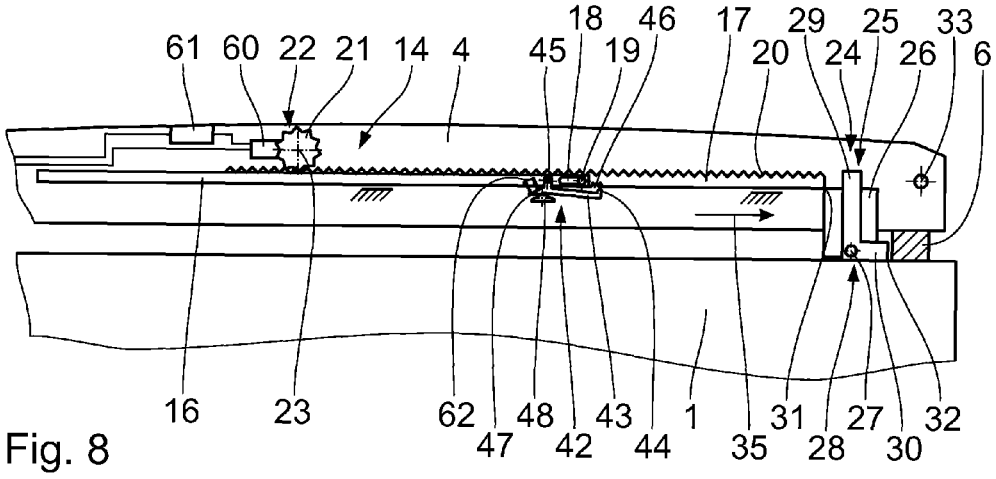
Figure 9:
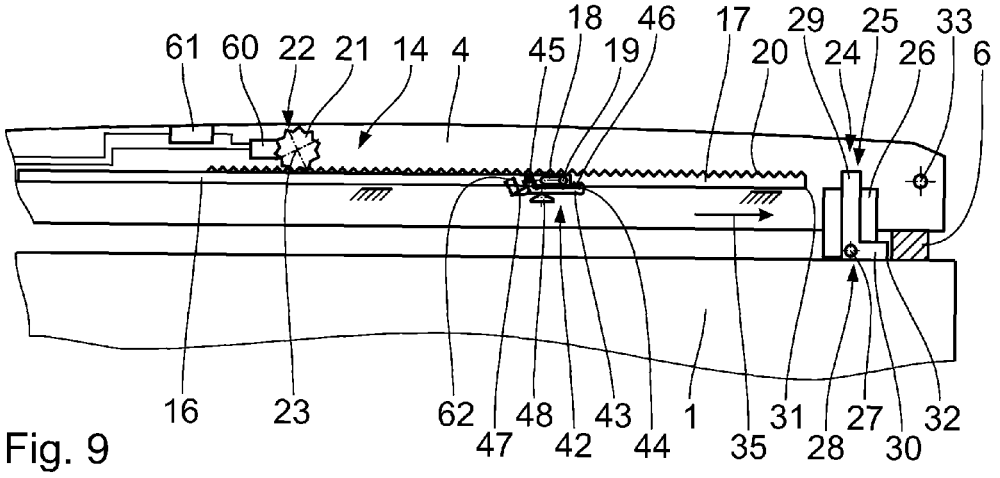

The following is a description of a third embodiment of the invention with reference to FIGS. 7 to 9. Identical parts are denoted by the same reference numerals as in the first embodiment to the description thereof reference is made. The difference to the first embodiment is that a locking device 42 is provided by means of which the displaceability of the two components 16, 17 of the gear rack 14 relative to each other is lockable. The locking device 42 comprises a locking lever 43 with a locking protrusion 44. The locking lever 43 is articulated to the first component 16 of the gear rack 14 so as to be pivotable about a locking lever axis 45. Furthermore, the second component 17 of the gear rack 14 comprises several locking notches 46 which are adapted to the shape of the locking protrusion 44. The relative position of the first component 16 of the gear rack 14 relative to the second component 17 of the gear rack 14 is lockable by an engagement of the locking protrusion 44 of the locking lever 43 with one of the locking notches 46. The locking device 42 further comprises a spring 62 which moves the locking lever 43 about the locking lever axis 45 in such a way that the locking protrusion 44 on the locking lever 43 engages with the locking notch 46 in the second component 17 of the gear rack 14.

On the end of the locking lever 43 opposite to the locking nose 44, said locking lever 43 comprises a first unlocking element 47 in the shape of a chamfer. The first unlocking element 47 is arranged perpendicular to the actuation direction 35. The first unlocking element 47 is in particular designed in such a way that when the gear rack 14 is displaced in the actuation direction 35, the first unlocking element 47 interacts with a second unlocking element 48 attached to the door 4 as soon as the gear rack 14 has reached a particular position. The second unlocking element 48 is a wedge-shaped attachment. Said attachment is arranged on the door 4 at such a distance from the gear rack 14 that when the gear rack 14 is displaced in the actuation direction 35, it is only engageable with the chamfered first unlocking element 47. When the gear rack 14 is displaced in the actuation direction 35, the second unlocking element 48 engages with the first unlocking element 47 of the locking lever 43 as soon as the first component 16 of the gear rack 14 has reached a particular position as shown in FIG. 9, causing the locking lever 43 to be pivoted about the locking lever axis 45 in such a way that the locking protrusion 44 on the locking lever 43 is retracted from the locking notch 46 so that the first component 16 of the gear rack 14 is released from the second component 17 of the gear rack 14. The two components 16, 17 of the gear rack 14 are thus unlocked, allowing the second component 17 of the gear rack 14 to be displaced further in the actuation direction 35. On the other hand, the two components 16, 17 of the gear rack 14 are only displaceable relative to each other when the gear rack 14 is displaced opposite to the actuation direction 35 as long as the two unlocking elements 47, 48 are in engagement with each other. As soon as the first component 16 of the gear rack 14 has been displaced in the opening direction 36 to such an extent that the second unlocking element 48 is disengaged from the first unlocking element 47, the locking protrusion 44 on the locking lever 43 engages with the locking notch 46 in the second component 17 of the gear rack so that the two components 16, 17 of the gear rack 14 are no longer displaceable relative to each other.

Apart from the actuation of the handle 25 of the opener 24 in order to overcome the initial resistance when opening the door 4, the two components 16, 17 of the gear rack 14 are therefore non-displaceable relative to each other virtually in the entire pivoting range of the door 4 relative to the housing 1. An idle stroke for actuating the handle 25 is therefore only provided in the range of a small opening angle of less than 10°, in particular less than 5° of the door.

A corresponding locking device 42 may of course also be provided in the embodiment according to FIGS. 3 to 6.

Figure 10:
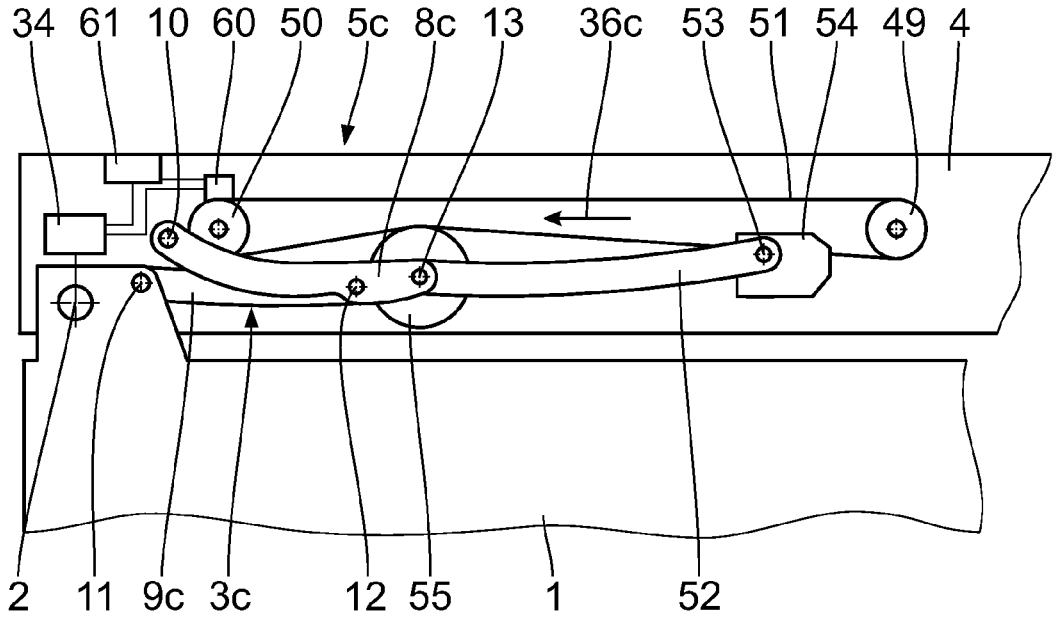
FIG. 10 is a view of an arrangement according to a fourth embodiment with the door in the closed position.
Figure 11:
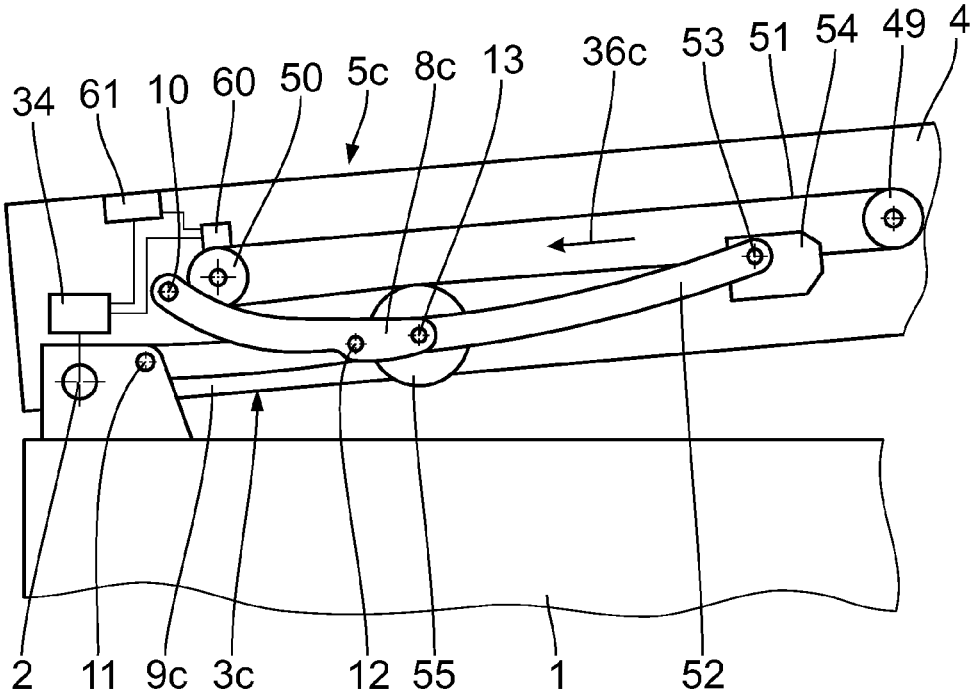
FIG. 11 is a view of the arrangement according to FIG. 10 with the door in the open position.

The following is a description of a fourth embodiment of the invention with reference to FIGS. 10 and 11. Identical parts are denoted by the same reference numerals as in the first embodiment to the description thereof reference is made. Differently constructed but functionally identical parts are denoted by the same reference numerals with a subsequent c. The main difference with respect to the first embodiment is that the drive device 5*c* comprises a belt 51 which runs across two pulleys 49, 50. The belt 51 is elastic. The belt 51 may also be a toothed belt, a rope or a chain. The two pulleys 49, 50 are mounted on the door 4 in such a way as to be rotatable, in particular drivable for rotation. The belt 51 extends substantially linearly between the two pulleys 49, 50; the drive device 5*c* is therefore referred to as linear drive as in the preceding embodiments.

The hinge 3*c* comprises the first leg 8*c* which is articulated to the door 4 via the first joint 10, the second leg 9*c* which is articulated to the housing 1 via the second joint 11 and to the first leg 8*c* via the third joint 12, and a third leg 52 which is articulated to the first leg 8*c* via the fourth joint 13. Via a fifth joint 53, the third leg 52 is pivotally connected to a carriage 54 which is displaceable by means of the belt 51. The first leg 8*c* is arcuate, in other words curved. Likewise, the third leg 52 is arcuate, in other words curved, as well.

The hinge 3*c* further comprises a tension pulley 55 which is mounted for rotation on the fourth joint 13. The belt 51 is guided over the tension pulley 55. When the door 4 is closed, the belt 51 is deflected by the tension pulley 55 from its linear course between the pulleys 49, 50 and is thus pretensioned. The tension in the belt 51 increases when the door 4 is opened, thus causing the tension pulley 55 to be pressed against the housing 1 in such a way that the initial resistance when opening the door 4 is overcome. When this happens, the fourth joint 13 passes through an overstretched position of the first leg 8*c* relative to the third leg 52, in other words the fourth joint 13 passes through a dead center position of one of these two legs relative to the other. The dead center position of the first leg 8*c* relative to the third leg 52 ensures that the door 4 is reliably closed. Beyond the dead center, a displacement of the carriage 54 in the opening direction 36*c* by means of the belt 51 causes the door 4 to be pivoted about the pivot axis 2 so that the door 4 is opened.

Figure 12:
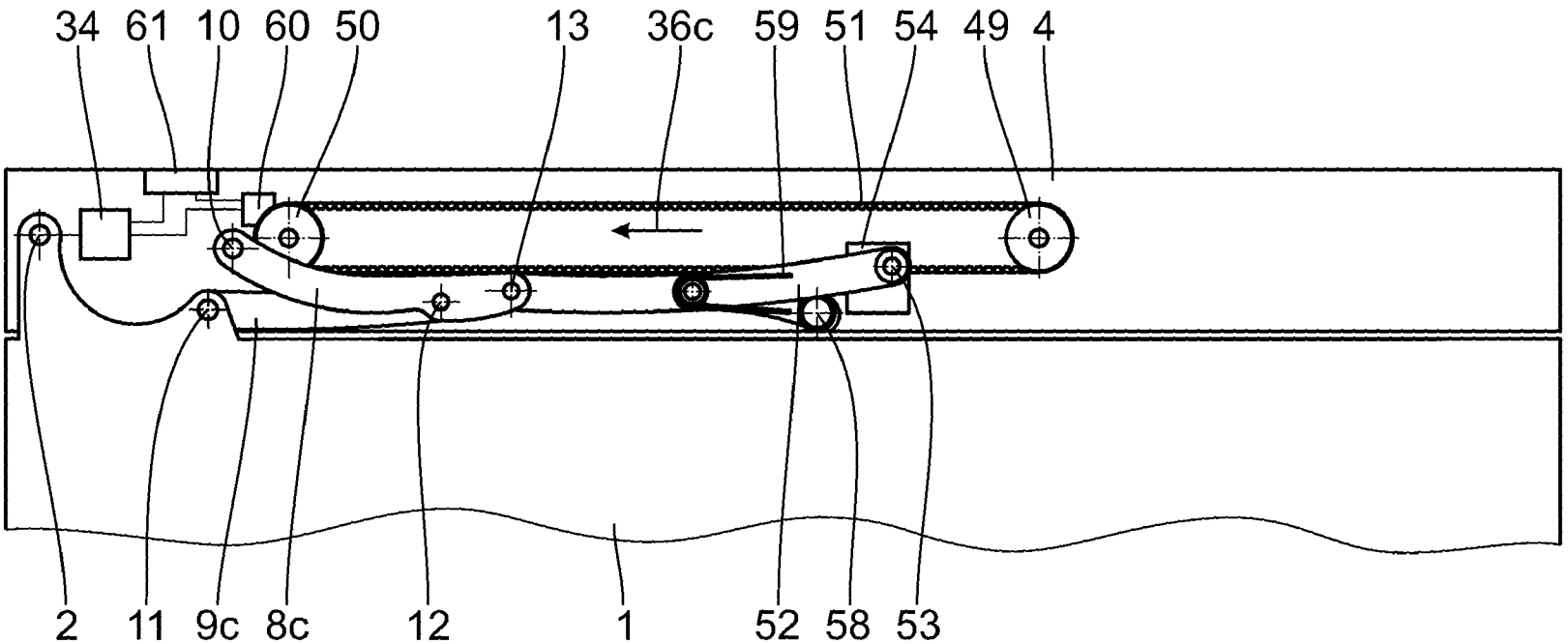
FIGS. 12, 13 and 14 are views of an arrangement according to a fifth embodiment.
Figure 13:
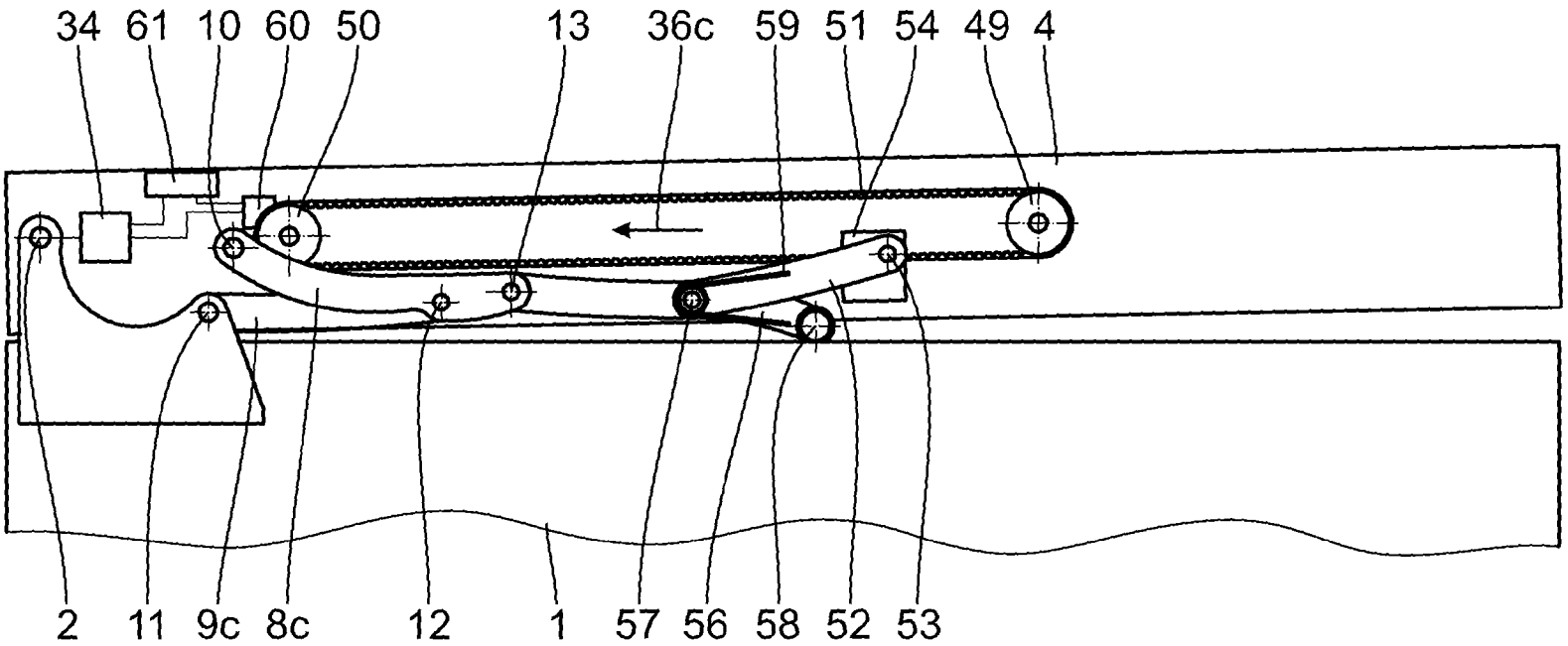
Figure 14:
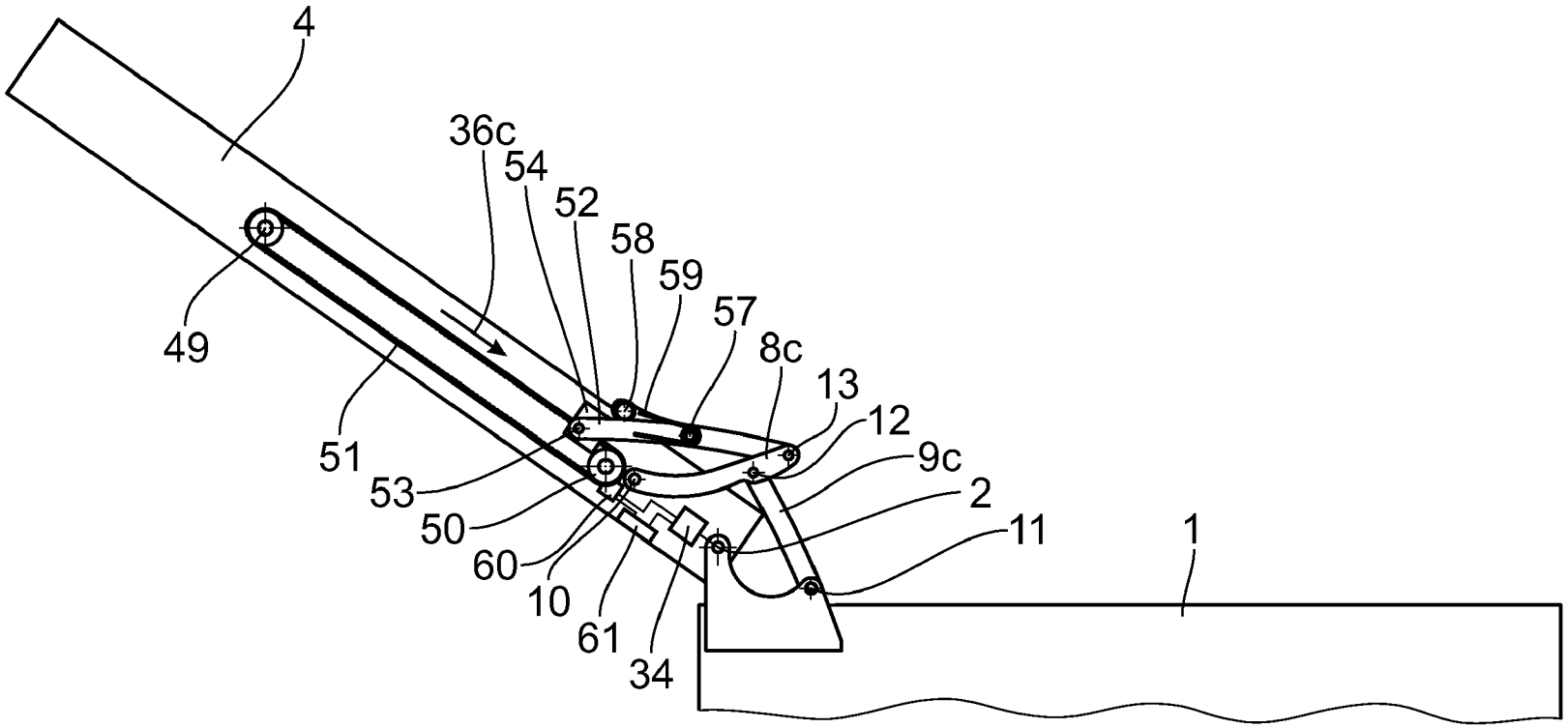

The following is a description of a fifth embodiment of the invention with reference to FIGS. 12 to 14. Identical parts are denoted by the same reference numerals as in the fourth embodiment to the description thereof reference is made.

The main difference to the fourth embodiment is that instead of the tension pulley is provided a fourth leg 56 which is articulated to the third leg 52 by means of a sixth joint 57.

On the free end of the fourth leg 56 is arranged a support pulley 58 which abuts the housing 1 when the door 4 is closed. In the region of the sixth joint 57 is provided a spring 59 which is pre-loaded when the door is closed 4 and presses the fourth leg 56 together with the support roller 58 against the housing 1.

In another embodiment (not shown), the opener 24 is intended to be electromagnetic. This is particularly advantageous in the case of doors with a magnetic fastener. In order to open the door 4, a magnetic field is generated in the opener 24 according to this embodiment which interacts with a magnetic field of a permanent magnet integrated in the housing 1 only to such an extent that the door is opened 4.

What is claimed is:

1. An arrangement comprising:

a housing (1);

b. a door (4) which is articulated to the housing (1) so as to be pivotable about a pivot axis (2) of a hinge (3; 3*c*);

at least one drive device (5; 5*c*) for pivoting the door (4) relative to the housing (1);

wherein the drive device (5; 5*c*) comprises a motor-driven drive unit (60) by means of which a moment is exertable on the door (4) relative to the hinge axis (2) via at least one force transmission means (14; 51);

wherein the housing (1) belongs to at least one of the group consisting of a cooling device and a freezing device; and wherein the drive device (5; 5*c*) is integrated in the door (4).

2. An arrangement according to claim 1, wherein in addition thereto, an opener (24) is provided for deflecting the door (4) from a closed position.

3. An arrangement according to claim 2, wherein the opener (24) is actuable manually and by means of the drive device (5; 5*c*).

4. An arrangement according to claim 1, wherein the at least one force transmission means (14; 51) is coupleable to the drive unit (60) via a coupling.

5. An arrangement according to claim 1, wherein the drive device (5; 5*c*) is a linear drive.

6. An arrangement according to claim 1, wherein the at least one force transmission means (14) is articulated to the hinge (3).

7. An arrangement according to claim 1, wherein the force transmission means (14) is a gear rack.

8. An arrangement according to claim 7, wherein the gear rack is comprised of at least two components, with the at least first gear rack component (16) being displaceable relative to the at least second gear rack component (17).

9. An arrangement according to claim 1, wherein a sensor (34) is provided.

10. An arrangement according to claim 9, wherein the sensor (34) is an angle sensor which is coupled to the pivot axis (2) for detecting an open position of the door (4).

11. An arrangement according to claim 1, wherein a control unit (61), which is connected to the drive device (5; 5*c*) for data transmission, is provided for controlling the drive device (5; 5*c*).

12. An arrangement according to claim 11, wherein at least one parameter of the pivotability of the door (4) is adjustable by means of the control unit (61).

13. An arrangement comprising a housing (1);

a door (4) which is articulated to the housing (1) so as to be pivotable about a pivot axis (2) of a hinge (3; 3*c*);

at least one drive device (5; 5*c*) for pivoting the door (4) relative to the housing (1); and wherein the drive device (5; 5*c*) comprising a motor-driven drive unit (60) by means of which a moment is exertable on the door (4) relative to the hinge axis (2) via at least one force transmission means (14; 51);

wherein the force transmission means (51) belongs to at least one of the group consisting of a belt, a rope and a chain;

wherein the housing (1) belongs to at least one of the group consisting of a cooling device and a freezing device; and wherein the hinge (3*c*) comprises a first leg (8*c*) which is articulated to the door (4) via a first joint (10), a second leg (9*c*) which is articulated to the housing (1) via a second joint (11) and which is articulated to the first leg (8*c*) via a third joint (12), and said hinge (3*c*) comprises a third leg (52) which is articulated to the first leg (8*c*) via a forth joint (13).

14. An arrangement according to claim 13, wherein the force transmission means (51) is a toothed belt.

15. An arrangement according to claim 13, wherein the first transmission means (51) is an elastic belt.

16. An arrangement according to claim 13, wherein a carriage (54) is provided that is pivotally connected via a fifth joint (53) to the third leg (52), wherein said carriage (54) is displaceable by means of the belt (51).

17. An arrangement according to claim 13, wherein the first leg (8*c*) is arcuate.

18. An arrangement according to claim 13, wherein the third leg (52) is arcuate.

19. An arrangement according to claim 13, wherein the hinge (3*c*) further comprises a forth leg (56) which is articulated to the third leg (52) via a sixth joint (57).

20. An arrangement according to claim 19, wherein a support pulley (58) is arranged on a free end of the fourth leg (56), wherein said support pulley (58) abuts the housing (1) when the door (4) is closed.

21. An arrangement according to claim 20 wherein in the region of the sixth joint (57) is provided a spring (59) which is pre-loaded when the door (4) is closed and which presses the fourth leg (56) together with the support pulley (58) against the housing (1).

22. An arrangement comprising:

a housing (1);

a door (4) which is articulated to the housing (1) so as to be pivotable about a pivot axis (2) of a hinge (3; 3*c*);

at least one drive device (5; 5*c*) for pivoting the door (4) relative to the housing (1); and wherein the drive device (5; 5*c*) comprising a motor-driven drive unit (60) by means of which a moment is exertable on the door (4) relative to the hinge axis (2) via at least one force transmission means (14; 51);

wherein the force transmission means (51) belongs to at least one of the group consisting of a belt, a rope and a chain; and wherein the housing (1) belongs to at least one of the group consisting of a cooling device and a freezing device; and wherein the force transmission means (51) runs across two pulleys (49, 50).

23. An arrangement according to claim 22, wherein the two pulleys (49, 50) are drivable for rotation.

* * * * *

UNITED STATES PATENT AND TRADEMARK OFFICE

CERTIFICATE OF CORRECTION

PATENT NO. : 8,347,553 B2
APPLICATION NO. : 12/508970
DATED : January 8, 2013
INVENTOR(S) : Hecht et al.

It is certified that error appears in the above-identified patent and that said Letters Patent is hereby corrected as shown below:

On the Title Page

At item (75) Inventors, delete "Jens Scharg" and insert --Jens Scharf--.

Signed and Sealed this
Seventh Day of May, 2013

Teresa Stanek Rea
*Acting Director of the United States Patent and Trademark Office*